United States Patent [19]

Van Doorn et al.

[11] 3,974,763

[45] Aug. 17, 1976

[54] PROCESS FOR BALING FIBERS

[75] Inventors: Donald W. Van Doorn, Columbus, Ga.; Jack L. Colquett, Schlater, Miss.; James B. Hawkins, Columbus, Ga.; William C. Pease, III, Columbus, Ga.; Tommy W. Webb, Columbus, Ga.

[73] Assignee: Lummus Industries, Inc., Columbus, Ga.

[22] Filed: Aug. 7, 1975

[21] Appl. No.: 602,896

Related U.S. Application Data

[62] Division of Ser. No. 426,089, Dec. 19, 1973, Pat. No. 3,916,778.

[52] U.S. Cl. ..... 100/35

[51] Int. Cl.[2] ..... B30B 13/00

[58] Field of Search ..... 100/3, 4, 26, 35, 48, 100/50, 99, 52, 53

[56] References Cited

UNITED STATES PATENTS

| | | | |
|---|---|---|---|
| 3,762,312 | 10/1973 | Guhl | 100/52 |
| 3,785,278 | 1/1974 | Hopkins | 100/52 |
| 3,827,350 | 8/1974 | Gilman | 100/52 |
| 3,855,919 | 12/1974 | Potter | 100/52 |
| 3,861,296 | 1/1975 | Clar | 100/53 |
| 3,861,297 | 1/1975 | Considine | 100/53 |

*Primary Examiner*—Billy J. Wilhite

*Attorney, Agent, or Firm*—Jennings, Carter & Thompson

[57] ABSTRACT

Process for baling fibers to uniform density within a fixed range even through the bales vary in weight or size. The invention results in bales which exert substantially the same force against the restraining ties or straps placed thereabout, which forces are within safe strength limits for the ties. The application discloses apparatus which may be used to carry out the process including controls for preventing overstressing the press and for actuating an automatic strapping apparatus only at the proper time.

5 Claims, 6 Drawing Figures

PROCESS FOR BALING FIBERS

This application is a division of our co-pending application Ser. No. 426,089, filed Dec. 19, 1973 now Patent No. 3,916,778.

Our invention relates to a process for baling fibers such as cotton and man-made fibers.

In the art to which our invention relates, both natural and man-made fibers usually are baled by placing them in the press box of a movable platen press and while in such press and while held under compression, some form of restraining means such as ties are passed about the bales. Then the pressure is released and the bale expands against the ties, whereby the bale is formed and may be removed from the press, the fibers being held compressed by the ties.

In baling both cotton and man-made fibers there is a problem concerning the inherent bale resilience variation, expecially in cotton, where the cotton gins cannot control variations of the bales within fifty to seventy-five pounds in weight and no closer than 2% to 3% moisture. Both weight and moisture affect the force required to produce bales of a given size. With respect to man-made fibers, other characteristics such as crimp and denier of the filaments affect the force required to produce bales of a given size.

Heretofore, all automatic baling and strapping systems with which we are familiar used a fixed "shut height". "Shut height" is the distance between the top and bottom platens at final compression and during the time the straps are applied, usually with automatic machinery. The compressive forces at shut height increase not just linearly, but geometrically as the bale weight increases or as the moisture decreases. Therefore, with a fixed shut height the ram compression force required to bring the moving platen to shut height position may be twice as much for a bale 10% overweight or 2% lower in moisture than the average bale. To provide a compressive force twice that normally required can easily increase the cost of the press by one-third. Involved in this increase is the fact that twice the ram area must be provided, twice the pumping capacity must be added and the press frame strength must be doubled.

In order to overcome the above problem we have developed a system for use with automatic banding equipment which will allow the shut height to vary within a predetermined range in proportion to the resilience of the bale which in turn is a function of bale weight and moisture content, insofar as cotton is concerned, and in the case of man-made fiber, other characteristics such as crimp and denier of the filaments. Our system employs strapping chutes in the moving platen having wide bell mouths at their entry points. These bell mouths will accommodate shut height variations in the neighborhood of five inches. While bell mouth chutes per se are old in the art, our invention uses them in combination with unique means for stopping the moving platen. Heretofore, a single limit switch has been used to stop the moving platen at a given position, regardless of the amount of fiber in the given bale being formed or the reaction force exerted by the fiber at final compaction. In prior apparatus, such limit switch is actuated by a mechanical cam device in turn actuated by movement of the platen. Also, it is old in the art to use pressure switches to stop the moving platen at various heights when bales are strapped manually. So far as we are aware, when equipped with automatic strapping systems prior apparatus has of necessity been limited to a substantially single shut height position.

In view of the foregoing and in order to overcome the problems set forth, we propose, as one means for carrying out our process, apparatus of the character indicated which shall in part employ two limit switches, the first of which will produce a signal when the moving platen has reached the point at which the large bell mouth can successfully receive the strap at the widest shut height position. A second limit switch will detect when the moving platen has reached the smallest shut height position at which the strap will still properly be received by the bell mouth. In combination with the two switches above set forth we employ a hydraulic pressure sensing device to stop the moving platen when a preset pressure or force has been reached. Tied into this system are controls for the automatic strapping apparatus which go into action only after the first limit switch has been actuated. If a bale is too overweight to allow the platen to reach the first limit switch, the pressure device will stop the moving platen, but the strapping machine will not actuate. The press thus will have protected itself from overstressing, but the bale will have to be manually strapped out. A further refinement of our invention incorporates means to vary the preset pressure of the aforementioned hydraulic pressure sensing device. This preset pressure may be set at an amount well below the maximum capability of the press components, at a value sufficient to produce the desired density on the bales whose resilience results in shut heights within the shut height range of our apparatus. A hydraulic system relief valve is additionally provided that is set at the maximum pressure the press components can safely withstand. In this refinement of our system the controls are arranged to allow the hydraulic pump(s) to continue to run if an oversize bale should cause the hydraulic pressure to exceed the preset amount of the hydraulic pressure sensing device before the maximum shut height position has been reached. This refinement allows the maximum force of the press to be applied, if necessary, to bring the occasional very oversize bale to within the shut height range for automatic strapping while a lesser force is applied to the large majority of the bales, thus relieving the press of unnecessary stressing. Normally, the moving platen will pass the first limit switch position and the pressure device will stop the platen somewhere between the first and second limit switch positions. If, however, a bale is unusually underweight the second limit switch will stop the moving platen and the automatic strapping device will strap out the bale at the minimum shut height position.

Still a further refinement of our apparatus shortens the total cycle time by starting the initial stage or stages of the automatic strapping apparatus when the powered platen reaches the maximum shut height position. The final strapping stages of tensioning the bands and securing the ends together are started only after the powered platen has stopped upon reaching the preset pressure or having reached the minimum shut height position.

Summarizing, the principle objects of our process and apparatus may be stated to be as follows: (1) to bale fibers to a maximum density for each bale with a given compressive force; (2) to reduce overstressing of bale ties on overweight bales by holding the compressive force uniform, whereby the size of the bale varies in proportion to its weight. Thus the stresses on the ties are the same, regardless of the weight of the bale, within the limits of the apparatus; (3) to provide apparatus having control means which: (a) causes the automatic strapping apparatus to function only when the platens are within the limits of the shut height; (b) causes the automatic strapping apparatus to function when the platens are within the limits of the shut height and when a predetermined maximum compressive force is being exerted on the bale; (c) causes the automatic strapping apparatus to function when the minimum shut height is reached even though the compressive force has not reached the predetermined value; (d) which in the event of reaching a predetermined compressive force prior to reaching maximum shut height allows the pressure to continue to rise up to an absolute allowable maximum force whereby in many cases maximum shut height may be reached with a considerably overweight bale; (e) which will detect small platen separating movements, such as those caused by leakage in control valves, etc., within the shut height range and will cause the hydraulic system to move the platen back to the position where it initially stopped, thus assuring that the platen remains substantially in a given position during the strapping operation to assure that uniform strap lengths are applied to a given bale.

Apparatus which may be used to carry out our improved process is shown in the accompanying drawings forming a part of this application in which.

Figure 1:
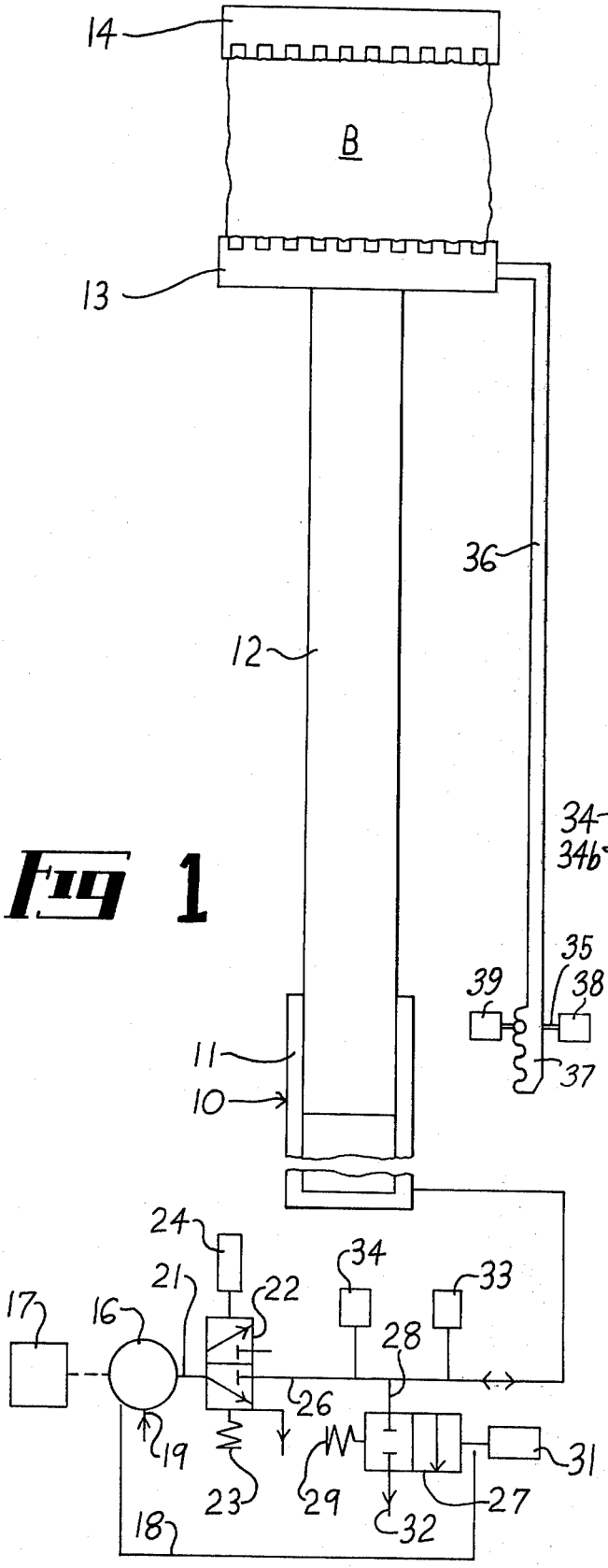
FIG. 1 is a wholly diagrammatic view illustrating an up-packing press with a simplified hydraulic powering and control system therefor.

Referring now to the drawings for a better understanding of our invention and particularly to FIG. 1, we show in wholly diagrammatic manner a hydraulic unit indicated generally by the numeral 10 and which embodies the cylinder or casing proper 11 and the piston rod or ram 12. Carried by the piston rod is a lower platen 13. An upper platen 14 is shown and, as understood in the art, this platen may be movable or may be fixed. Furthermore, while we illustrate an up-packing arrangement, as the description proceeds it will be apparent that our invention is equally applicable to downpacking presses.

Also, as is customary in the art the platens 13 and 14 are associated with some form of press box or filling chamber to receive the fibers so that when they move relatively toward each other the fibers are compressed therebetween. In view of the fact that the press boxes and filling chambers are old in the art and vary so widely, we have eliminated them from the drawings, a specific showing of them not being necessary for a full understanding of our invention.

Still referring to FIG. 1, we show in diagrammatic form a hydraulic system for admitting fluid beneath the lower end of the ram 12. A pump 16 is driven by a suitable prime mover such as an electric motor 17. A fluid reservoir 18 contains a supply of fluid which is delivered to the pump through a line 19. The outlet line 21 of the pump is connected to the inlet side of a valve 22 which is biased to the position illustrated by a spring 23, whereby in the position shown fluid entering the pump is by-passed back to the reservoir.

Operatively connected to the valve 22 is a solenoid 24. As will later appear, when solenoid 24 is energized, fluid under pressure from pump 16 is supplied through line 26 to the lower end of the cylinder 11, thereby raising the ram and hence its platen 13.

A dump valve 27 is connected by a line 28 to the line 26. The valve 27 normally is closed by a spring 29 and may be opened by a solenoid indicated at 31. Therefore, with the valve 27 closed by its spring 29 and with valve 22 actuated by its solenoid 24 pressure is supplied to raise the platen 13. Energization of solenoid 31 opens the dump valve 27 permitting the fluid holding the ram up to be forced by the weight of the parts back into the reservoir through line 28 and discharge line 32. As will later appear, whenever solenoid 31 is energized solenoid 24 is deenergized.

For purposes later to appear, also in hydraulic communication with line 26 is a pressure sensor 33 set to respond to a preset optimum force in the system. Similarly, a pressure sensor 34 is in hydraulic communication with line 26 to sense a maximum allowable system force.

Referring again to FIG. 1, platen 13 carries a cam rod or bar 36 the lower end of which carries what might be called a "washboard" cam section 37. It will be understood that the rod 36 and the washboard section thereof move up and down with the platen 13.

At 38 we show an electric switch the arm 35 of which engages the side of the cam rod 36, this to close switch 38 so long as its arm is in contact with the side thereof. As will later appear, switch 38 not only is the minimum shut height control switch, but also is a safety switch inasmuch as if its arm were to break or it were otherwise to become inoperative the upper movement of the ram would be halted. Furthermore, switch 38 has a set of contacts effective to energize automatic strapping mechanism as also will appear.

At 39 we show a normally open switch having a switch arm 39$^{a}$. The switch arm 39$^{a}$ is adapted to be engaged by the washboard section 37 of the control rod 36 to close and open the switch 39 alternately as the platen advances upwardly in the strap zone or position of the platen.

Figure 2:
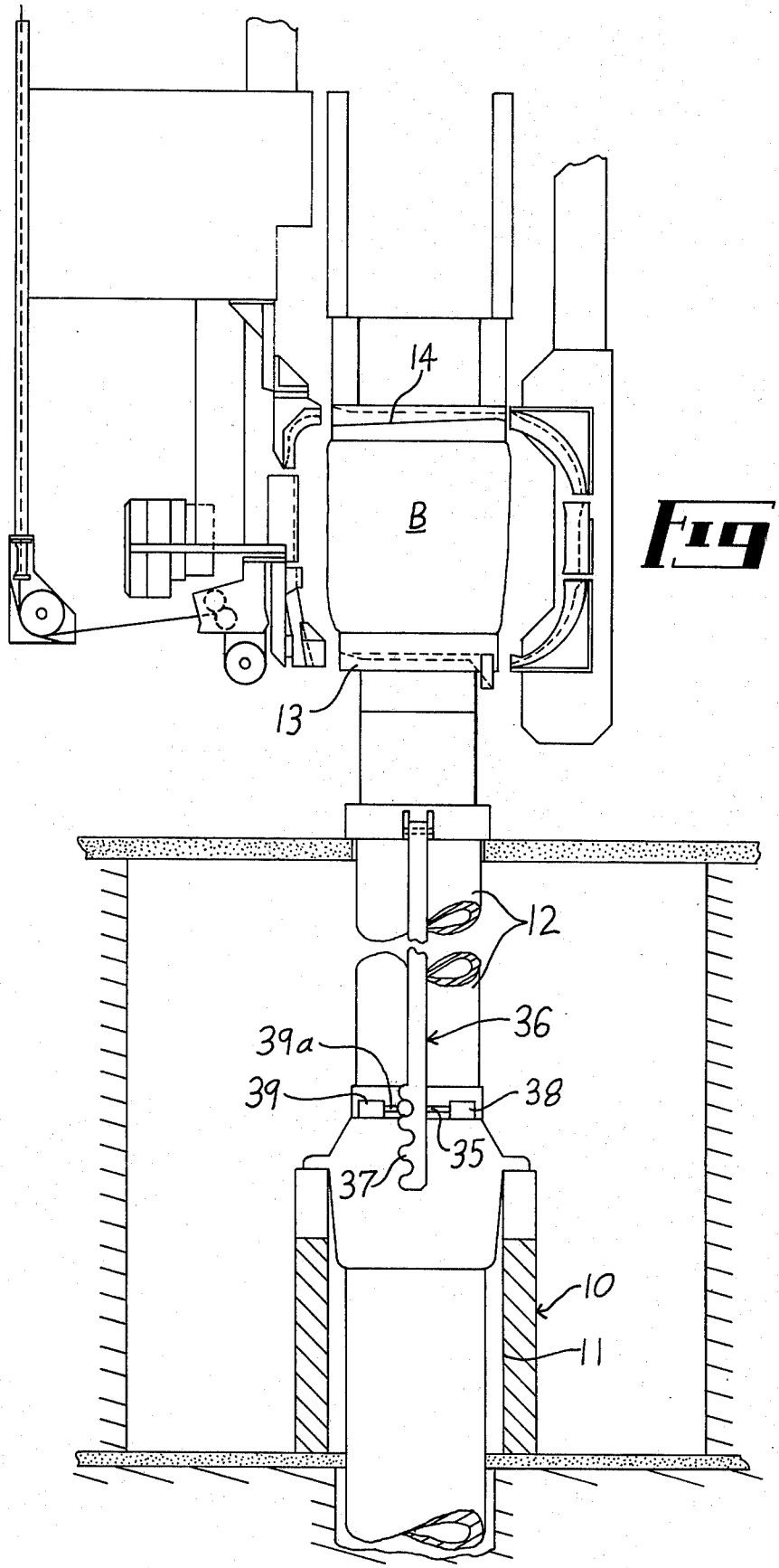
FIG. 2 is a wholly diagrammatic side elevational view, certain of the parts being in section illustrating a bale of fibers between the platens of a press, ready for the automatic strapping mechanism to place straps about the same.
Figure 3:
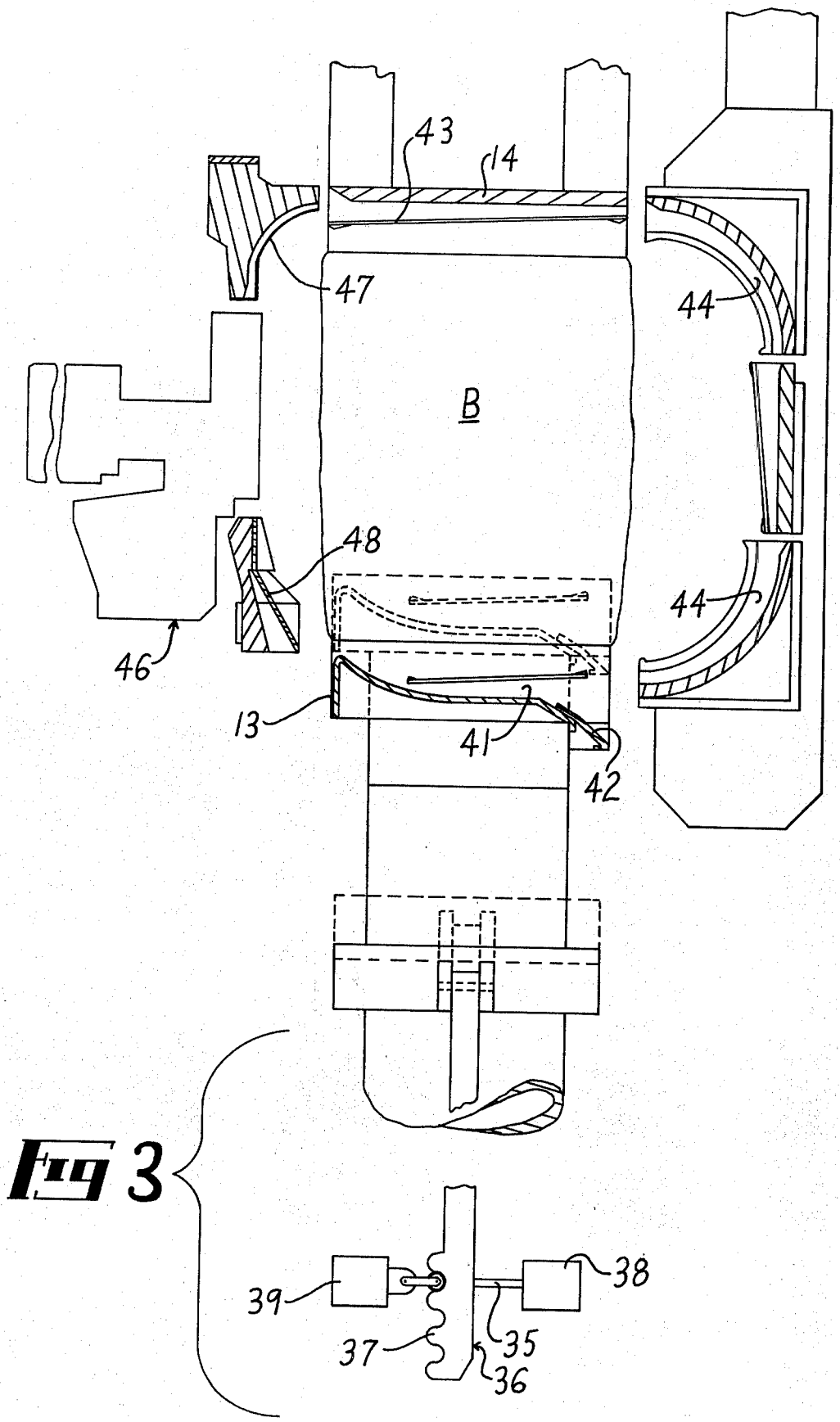
FIG. 3 is an enlarged, detailed sectional view showing a bale between the platens, and illustrating in full lines the position of the lower platen at maximum shut height position and in dotted lines at minimum shut height position.

Referring now to FIGS. 2 and 3 we show platen 13 as being equipped with a plurality of transversely disposed strap guides indicated at 41. On the strap receiving ends these guides are bell mouthed as indicated at 42 to provide a wide, vertically elongated space to receive the end of the strap. As will be understood these straps are relatively thin lengths of steel banding or the like.

The working surface of the platen 14 is provided with a plurality of slots to receive the strap guides 43. Along the sides of the baling area between the platens are other strap guides 44, one for each strap to be placed about the bale.

Opposite the guides 44 and indicated diagrammatically at 46 is a traversing, automatic strap delivering and tying device having delivery guides 47 for projecting the end of the strap first into the strap guides 43 and thence around the bale, clockwise as viewed in FIGS. 2 and 3. A lower guide 48 carried by or associated with the mechanism 46 receives the free end of the strap and overlaps it with the portion of the strap coming from a roll of the same. It will be noted that the strap guide 48 is also vertically elongated to receive the free end of the strap from the guide 41. As is well known in the art the apparatus 46 then places a seal about the overlapped portions of the strap, severs the strap length wrapped around the bale from the roll of the same and then moves to the next set of guides for delivery of a subsequent strap.

It will be understood that the strapping operation just described is carried out while the bale is held under compression between the upper and lower platens. It will further be understood that the automatic strapping apparatus has means to cause it to traverse from strap guide to strap guide. In particular, a suitable form of such strapping apparatus is described in U.S. Letters Pat. No. 3,521,550 dated July 21, 1970.

As stated in the beginning, our invention contemplates bringing substantially every bale to a predetermined density, within maximum and minimum shut heights, thus to obtain bales which may vary in size but which nonetheless are of approximately the same density.

Figure 4:
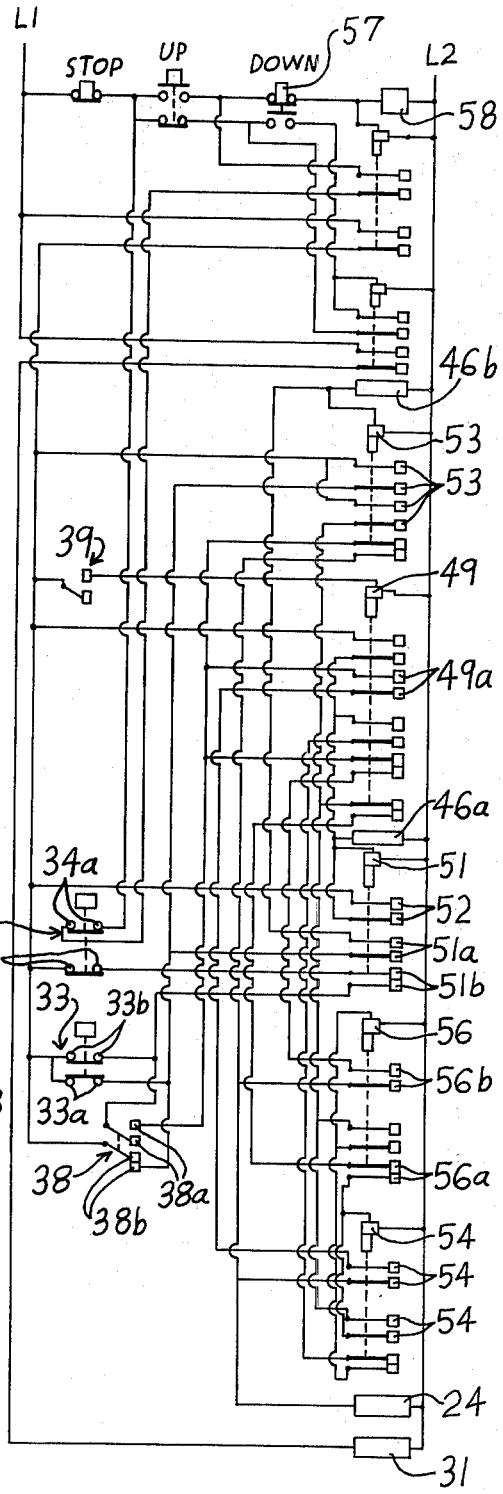
FIG. 4 is a wiring diagram.

In order more fully to understand our invention attention is now directed to FIG. 4, the diagrammatic wiring diagram. Assuming that pump 16 is running and the solenoid 24 is energized, whereby fluid under pressure is being supplied to line 26, thus to raise the ram, when the switch arm 39$^a$ rides up on the first ridge of the washboard section 37 switch 39 closes. The closing of switch 39 energizes relay 49, which, through its contacts and associated circuitry energizes relay 51. Relay 51 has a set of holding contacts 52 which close upon energization of relay 51 as shown. Continued upward movement of the ram then causes the switch arm 39$^a$ to fall into a valley of the washboard section, thus opening switch 39. Opening switch 39 deenergizes relay 49, but because of the holding contact 52 relay 51 remains energized. Assuming that at this height of the platen 13 the compressive force on the bale B is the optimum for which the system is set, then sensor 33 is actuated and through the contacts and circuitry shown solenoid 24 is deenergized, stopping the flow of fluid from the pump to the bottom of the ram. As shown, the energization of sensor 33 closes a set of contacts 3$^a$, which in turn energizes a relay 53 and also initiates the control circuits for the automatic strapping mechanism 46. Relay 53 is locked in through a set of contacts 51$^a$ controlled by relay 51 and a set of contacts 53$^a$ which of course were closed upon energization of relay 53. Thus, at this point in time the ram is now stopped in its upward movement with switch arm 39$^a$ resting in one of the valleys of the washboard section 37. In this position of switch arm 39$^a$, relay 49 is deenergized and a relay 54 is energized through the normally closed contacts 56$^a$ of another relay 56. Relay 54 is held energized through a set of holding contacts 54$^a$, thus preventing relay 56 from becoming energized. Assuming that there is some leakage beneath the ram so that fluid escapes back to the reservoir or elsewhere, platen 13 will creep downwardly. However, the reenergization of sensor 33 alone cannot reenergize solenoid 24 because, it will be remembered, relay 53 is now energized whereby the contacts 53$^b$ thereof at this time are open. Upon loss of pressure for any reason the platen creeps downwardly, again bringing the switch arm 39$^a$ onto the ridge of the washboard section. This again reenergizes relay 49. Solenoid 24 is again reenergized through contacts 54$^b$ and 49$^a$ and the reclosed contacts 33$^b$ of sensor 33, thus supplying fluid under pressure from the pump to the bottom of the ram. This raises the ram until the switch arm 39$^a$ moves from the ridge into the valley of the washboard section deenergizing relay 49. This opens contacts 49$^a$ deenergizing solenoid 24. If by chance the platen 13 has stopped with the switch arm 39$^a$ on a ridge instead of in a valley then relay 56 would have energized and locked in rather than relay 54. As shown in FIG. 4 this circuit is but the mirror image of the one already described whereby the ram would go upwardly pursuant to closing of 56$^b$.

Through the circuits just described the ram thus moves upwardly until the optimum system force is obtained and the mechanism described holds the ram in that position within very narrow limits. With the bale thus held in position within the allowable shut height range the strapping is applied and tied out and the bale may be removed by lowering the platen by pushing a "down" button indicated at 57.

Having now described the function of our improved process and apparatus in making a bale which requires only the optimum system force, we will now describe a situation in which our improved process and apparatus may be used to strap a bale having so little material in it as the system never reaches optimum system force. In other words, we will now describe how our process and apparatus is used to strap out a bale at minimum shut height.

When platen 13 moves up so far that the switch arm 35 runs off the end of the control rod 36, switch 38 is deactuated, opening contacts 38$^a$ and closing contacts 38$^b$. The opening of 38$^a$ contacts deenergizes solenoid 24. The closing of contacts 38$^b$ actuates the strapping mechanism 46 and relay 53 which functions as previously described. It will be noted that with the switch arm 35 out of contact with rod 36 arm 39$^a$ either is on a ridge or valley whereby the ram is maintained at substantially the same height it had attained when switch 38 was deactuated.

In some instances in practice it happens that the optimum system force is reached before the platen 13 reaches the maximum shut height. In some of the cases, for instance where the platen is almost but not quite within range, it is desirable to add additional pressure beneath the ram to at least reach the maximum shut height to strap such overweight bale. Our process and apparatus makes provision for this case as we will now describe. The actuation of sensor 33 and the opening of its contacts 33$^b$ do not in themselves deenergize solenoid 24. This is because relay 49 has never been energized and consequently relay 51 has not been energized, either. Therefore, contacts 51$^b$ are still closed, keeping solenoid 24 energized. The ram will continue upwardly until switch 39 is actuated by striking a ridge on the washboard section, energizing relay 49, in turn energizing relay 51, opening contacts 51$^b$. The strapping apparatus 46 is now actuated inasmuch as the ram 13 has reached at least the maximum shut height. It will here be noted that in the case of a normal or light bale contacts $51^b$ open prior to the opening of contacts $33^b$, whereas in the case just described the reverse is true.

We will now describe a circumstance in which so much fiber has been fed to the charging box that if allowed to continue in its upward stroke the apparatus would be overstressed and hence the means we provide to prevent this. Assuming again that so much fiber has been fed into the charging box that platen 13 will never reach even the maximum shut height prior to overstressing the press, in this event when the optimum system force is reached switch 33 is actuated opening its contacts $33^b$. The ram continues upwardly until the maximum allowable system pressure sensor 34 is actuated. It will be noted that this sensor 34 has two sets of normally closed contacts $34^a$ and $34^b$. When sensor 34 is actuated both of its sets of contacts are opened, $34^b$ causing the deenergization of solenoid 24 which immediately stops the flow of fluid to the bottom of the ram. The opening of contacts $34^a$ closes down the system by deenergizing a pump motor starter 58 which is in the system as illustrated in FIG. 4. The press has now come to rest, before reaching maximum shut height and before overstressing itself. Such a bale must then be strapped by hand and removed from the press.

It will be noted that when platen 13 reaches maximum shut height arm $39^a$ of switch 39 is actuated. This energizes relay 51 and initiates a first step in bringing the automated strapping apparatus into operation. By way of example, such first step may be to move the strapping apparatus into strapping position without waiting for the movable platen to reach its final position. Then, when the powered platen stops upon reaching the preset pressure or the minimum shut height, mechanism $46^b$ of the strapper apparatus is energized thus to initiate a second step in the strapping operation. Such second step may be the placing of the strap about the bale, tensioning of the strap, severing the strap from the roll and securing the ends together. Thus, with our improved apparatus a considerable time saving in the overall cycle is effected.

Figure 5:
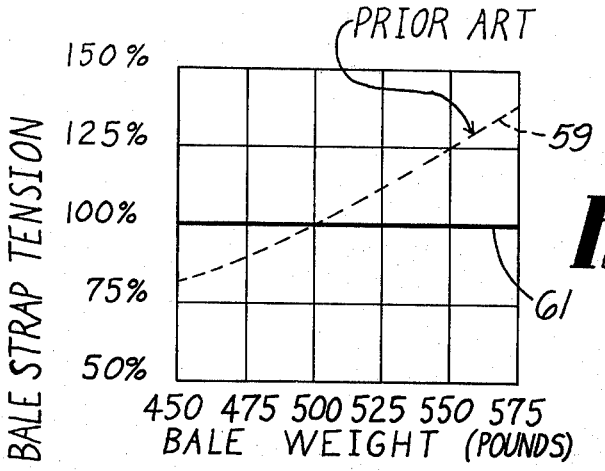
FIG. 5 is a graph illustrating the relationship between bale weight and bale strap tension when employing our invention as compared to the same relationships when employing the prior art apparatus and process for baling; and, FIG. 6 is a graph plotted to show the relationship between bale weight and bale density when employing our invention and when employing the prior art.

In view of the foregoing it will be seen that we have devised an improved process fully effective for the intended purposes herein set forth and which eliminates the difficulties mentioned herein. The advantages of our invention can be readily understood at a glance by referring to FIGS. 5 and 6. In the baling of fibers it is never desirable to have a bale containing so much fiber that when compressed to given dimensions more than a permissible load is placed on the straps when the bale is released to them. In FIG. 5 we have plotted bale weight versus bale strap tension and the line 59 indicates the wide variance between these factors which the prior art processes and apparatus impose upon the straps. By employing our invention as indicated by the line 61 in which the bales are all compressed to substantially the same density the tension on the straps is substantially constant throughout a fairly large range of bale sizes. In other words, a bale made in accordance with our invention whether compressed to maximum shut height or minimum shut height will, when released to its straps, exert pressure on these straps in accordance with line 61 of FIG. 5. This of course excludes those situations where the system pressure does not come up to optimum force, namely, where not enough fiber was put into the charging box really to need strapping to any extent, as for instance a remnant or partial bale. Also excluded is the situation where greater than nominal pressure is required to come within normal strapping range.

Figure 6:
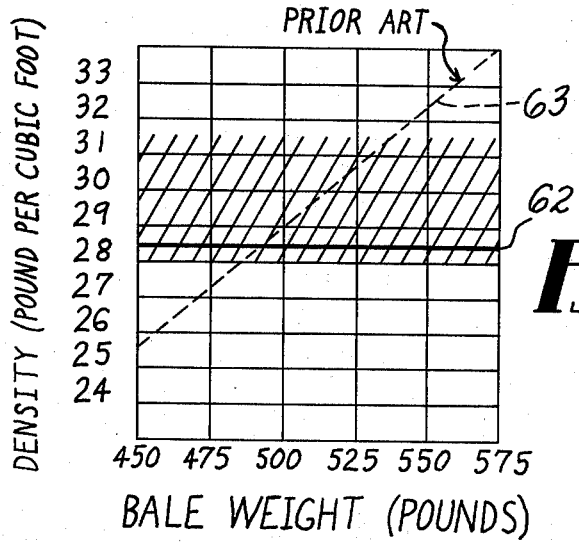

Furthermore, our invention makes it possible accurately and consistently to bale fibers which fall within the universal density range required by the cotton trade. In FIG. 6 the line 62 represents the density obtainable with our invention, consistently, for various weights of bales. The shaded portion of this figure indicates the permissible density for a bale to be classified as a "universal density bale". Line 63 shows the great variation, both below, within and above this desirable range, when following the teachings of the prior art.

In view of all the foregoing it will be seen that we have devised an improved and efficient system for baling fibers. Our invention lends itself to association with standard baling presses without material change in the platens, cylinders and rams themselves, all of which may be automated by the control systems described herein.

While we have shown our invention in but one form, it will be obvious to those skilled in the art that it is not so limited, but is susceptible of various other changes and modifications without departing from the spirit thereof.

What we claim is:

1. The process of baling batches of fibers which have varying characteristics affecting the amount of force required to form bales within a given maximum and minimum size range comprising:

a. compacting the fibers between a pair of platens at least one of which is power driven toward the other until the bale being formed exerts a substantially predetermined reaction force, b. generating a signal if said predetermined reaction force is reached before the bale reaches said maximum size, c. generating a signal if said predetermined reaction force is not reached when the bale reaches said minimum size, and d. utilizing the signals produced in (b) or (c) above, as the case may be, to stop further compaction of the bale.

2. The process of baling batches of fibers which have varying characteristics affecting the amount of force required to form bales within a given maximum and minimum size range comprising:

a. compacting the fibers between a pair of platens at least one of which is power driven toward the other until the bale being formed exerts a substantially predetermined reaction force, b. generating a signal if said reaction force is reached when the bale is within said maximum and minimum size range, c. generating a signal if said predetermined reaction force is reached before the bale reaches said maximum size, d. generating a signal if said predetermined reaction force is not reached when the bale reaches said minimum size, and e. utilizing the signals produced in (a), (b) or c. above, as the case may be, to stop further compaction of the bale.

3. The process of baling batches of fiber which have varying characteristics affecting the amount of force required to form bales within a given maximum and minimum size range comprising:

a. compacting the fibers between a pair of platens at least one of which is power driven toward the other until the bale being formed exerts a substantially predetermined reaction force, b. generating a signal if said predetermined reaction force is reached prior to the bale reaching said size range, and c. utilizing the signal produced in (b) above to exert a predetermined maximum allowable excess of compaction force on the bale, thereby to bring it within said size range.

4. The process of baling batches of fibers which have varying characteristics affecting the amount of force required to form bales within a given maximum and minimum size range comprising:

a. compacting the fibers between a pair of platens at least one of which is power driven toward the other until the bale being formed exerts a substantially predetermined reaction force, b. generating a signal if said predetermined reaction force is reached before the bale reaches said maximum size, and c. generating a signal if said predetermined reaction force is not reached when the bale reaches said minimum size.

5. The process of baling batches of fibers which have varying characteristics affecting the amount of force required to form bales within a given maximum and minimum size range comprising:

a. compacting the fibers between a pair of platens at least one of which is power driven toward the other until the bale being formed exerts a substantially predetermined reaction force, b. generating a signal if said reaction force is reached when the bale is within said maximum and minimum size range, c. generating a signal if said predetermined reaction force is reached before the bale reaches said maximum size, and d. generating a signal if said predetermined reaction force is not reached when the bale reaches said minimum size.

* * * * *